US009790773B2

(12) United States Patent
Aman et al.

(10) Patent No.: US 9,790,773 B2
(45) Date of Patent: Oct. 17, 2017

(54) SYSTEMS AND METHODS FOR PRODUCING GAS WELLS WITH MULTIPLE PRODUCTION TUBING STRINGS

(71) Applicants: Michael Elgie Aman, Edmond, OK (US); Paul A. Edwards, Bayfield, CO (US); Timothy Idstein, Houston, TX (US)

(72) Inventors: Michael Elgie Aman, Edmond, OK (US); Paul A. Edwards, Bayfield, CO (US); Timothy Idstein, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 595 days.

(21) Appl. No.: 14/339,236

(22) Filed: Jul. 23, 2014

(65) Prior Publication Data

US 2015/0027690 A1 Jan. 29, 2015

Related U.S. Application Data

(60) Provisional application No. 61/859,491, filed on Jul. 29, 2013.

(51) Int. Cl.
*E21B 43/14* (2006.01)
*E21B 43/12* (2006.01)

(52) U.S. Cl.
CPC ..... *E21B 43/14* (2013.01); *E21B 43/121* (2013.01)

(58) Field of Classification Search
CPC ..... E21B 43/14; E21B 43/121
See application file for complete search history.

(56) References Cited

U.S. PATENT DOCUMENTS 3,263,753 A 8/1966 Corley, Jr.
3,381,753 A * 5/1968 Fredd ..... E21B 43/14 137/112
3,448,803 A * 6/1969 Sizer ..... E21B 23/04 166/115
3,666,012 A 5/1972 Sizer et al.
4,226,284 A 10/1980 Evans
(Continued)

FOREIGN PATENT DOCUMENTS

WO 2012/058288 A2 5/2012
WO 2013010244 1/2013

OTHER PUBLICATIONS

PCT Search Report dated Jan. 5, 2015.

*Primary Examiner* — Nicole Coy
(74) *Attorney, Agent, or Firm* — John L. Wood

(57) ABSTRACT

A system for producing hydrocarbons from a subterranean well including a wellbore extending from a surface into a subterranean formation, the system including a wellhead disposed at the surface. In addition, the system includes a production tree coupled to the wellhead. Further, the system includes a casing coupled to the wellhead and extending into the wellbore. Still further, the system includes a first plurality of production tubing strings extending into the casing from the wellhead to a first production zone. Each of the first plurality of production tubing strings is configured to provide a fluid flow path for gases from the first production zone. The production tree is configured to selectively and independently control fluid flow through each of the first plurality of production tubing strings.

17 Claims, 6 Drawing Sheets

(56) References Cited

U.S. PATENT DOCUMENTS

| | | | | |
|---|---|---|---|---|
| 5,904,209 | A | 5/1999 | Kenworthy et al. | |
| 5,950,651 | A | 9/1999 | Kenworthy et al. | |
| 6,568,477 | B1 | 5/2003 | Dveyrin | |
| 7,954,547 | B2 * | 6/2011 | Lowe | E21B 43/122 166/250.15 |
| 8,235,112 | B2 * | 8/2012 | Lowe | E21B 43/122 166/105.5 |
| 8,261,838 | B2 | 9/2012 | Bullen | |
| 8,297,363 | B2 | 10/2012 | Kenworthy et al. | |
| 9,068,444 | B2 * | 6/2015 | Lane | E21B 34/00 |
| 2002/0007953 | A1 | 1/2002 | Liknes | |
| 2004/0200615 | A1 | 10/2004 | Wilde | |
| 2009/0321083 | A1 | 12/2009 | Schinagle | |
| 2010/0051267 | A1 | 3/2010 | Lowe | |
| 2011/0004352 | A1 | 1/2011 | Wilde et al. | |
| 2011/0073319 | A1 | 3/2011 | Wilson | |
| 2013/0043031 | A1 | 2/2013 | Tunget | |
| 2015/0027693 | A1 | 1/2015 | Edwards et al. | |

* cited by examiner

SYSTEMS AND METHODS FOR PRODUCING GAS WELLS WITH MULTIPLE PRODUCTION TUBING STRINGS

CROSS-REFERENCE TO RELATED APPLICATIONS

This application claims priority under 35 USC §119(e)(1) of prior U.S. Provisional Patent Application Ser. No. 61/859,491, filed Jul. 29, 2013, which is hereby incorporated by reference in its entirety.

STATEMENT REGARDING FEDERALLY SPONSORED RESEARCH OR DEVELOPMENT

Not applicable.

BACKGROUND

The invention relates generally to subterranean gas wells. More particularly, the invention relates to systems and methods for producing a single formation from a gas well using multiple production tubing strings.

Geological formations that yield gas also produce liquids that accumulate at the bottom of the wellbore. In general, the liquids comprise hydrocarbon condensate (e.g., relatively light gravity oil) and interstitial water from the reservoir. The liquids accumulate in the wellbore in two ways—as single phase liquids that migrate into the wellbore from the surrounding reservoir, and as condensing liquids that fall back into the wellbore during production of the gas. The condensing liquids actually enter the wellbore as vapors; however, as they travel up the wellbore, their temperatures drop below the respective dew points and they change phase into liquid condensate.

In some hydrocarbon producing wells that produce both gas and liquid, the formation gas pressure and volumetric flow rate are sufficient to lift the liquids to the surface. In such wells, accumulation of liquids in the wellbore generally does not inhibit gas production. However, in wells where the gas does not provide sufficient transport energy to lift liquids out of the well (i.e., the formation gas pressure and volumetric flow rate are not sufficient to lift liquids to the surface), the liquids accumulate in the wellbore.

For example, referring now to FIG. 1, a conventional system 10 for producing hydrocarbon gas from a well 20 is shown. Well 20 includes a wellbore 26 that extends through a subterranean formation 30 along a longitudinal axis 17. System 10 generally includes a wellhead 13 at the upper end of the wellbore 26, a production tree 12 mounted to wellhead 13, a primary conductor 21 extending from wellhead 13 into wellbore 26, a casing string ("casing") 22 coupled to wellhead 13 and extending concentrically through primary conductor 21 into wellbore 26, and a tubing string 40 coupled to tree 12 and extending through casing 22 into wellbore 26. An annulus 27 is formed between string 40 and casing 22. Tree 12 includes a plurality of valves 11 configured to regulate and control the flow of fluids into and out of wellbore 26 during production operations.

During operation, formation fluids (e.g., gas, oil, condensate, water, etc.) flow into the wellbore 26 from a production zone 32 of formation 30 via perforations 24 in casing 22. Thereafter, the produced fluids flow to the surface 15 through annulus 27. In most cases, the production zone 32 initially produces gas to the surface 15 through annulus 27 with sufficient pressure and volumetric flow rate to lift liquids that enter wellbore 26 from zone 32 through perforations 24. However, over time, the formation pressure and volumetric flow rate of the gas decreases until it is no longer capable of lifting the liquids that enter wellbore 26 to the surface 15. At some point, the gas velocity drops below the "critical velocity", which is the minimum velocity required to carry a droplet of water to the surface. As time progresses, droplets of liquids accumulate in the bottom of the wellbore 26, thereby forming a column of liquid. This column of accumulated liquids imposes a back-pressure on the production zone 32 that begins to restrict the flow of gas into wellbore 26, thereby detrimentally affecting the production capacity of the well 20. Consequently, once the liquids are no longer lifted to the surface by the produced gas, the well eventually becomes "loaded" as the liquid hydrostatic head imposes a pressure on the production zone sufficient to restrict and/or prevent the flow of gas from the production zone, at which point the well is "killed" or "shuts itself in."

BRIEF SUMMARY OF THE DISCLOSURE

These and other needs in the art are addressed in one embodiment by a method for producing gas from a well including a wellbore extending from a surface into a subterranean formation. In an embodiment, the method comprises: (a) installing a first production tubing string within the wellbore and (b) installing a second production tubing string within the wellbore. In addition, the method comprises (c) producing gas from a first production zone in the subterranean formation through the first production tubing string at a first velocity that is greater than a critical velocity after both (a) and (b). Further, the method comprises (d) shutting in the first production tubing string and opening the second production tubing string after (c) after the first velocity decreases below the critical velocity to transition the production of gas from the first production zone from the first production tubing string to the second production tubing string, wherein the first production tubing string has a first inner diameter and the second production string has a second inner diameter that is less than the first inner diameter. Still further, the method comprises (e) producing gas from the first production zone through the second production tubing string after (d) at a second velocity that is greater than the critical velocity.

These and other needs in the art are addressed in another embodiment by a system for producing hydrocarbons from a subterranean well including a wellbore extending from a surface into a subterranean formation. In an embodiment, the system comprises a wellhead disposed at the surface. In addition, the system comprises a production tree coupled to the wellhead. Further, the system comprises a casing coupled to the wellhead and extending into the wellbore. Still further, the system comprises a first plurality of production tubing strings extending into the casing from the wellhead to a first production zone, wherein each of the first plurality of production tubing strings is configured to provide a fluid flow path for gases from the first production zone. The production tree is configured to selectively and independently control fluid flow through each of the first plurality of production tubing strings.

These and other needs in the art are addressed in another embodiment by a method for producing gas from a well including a wellbore extending from a surface into a subterranean formation. In an embodiment, the method comprises: (a) installing a first flow path within the wellbore, wherein the first flow path has a first cross-sectional area and (b) installing a second flow path within the wellbore, wherein the second flow path has a second cross-sectional area that is smaller than the first cross-sectional area. In addition, the method comprises (c) flowing gas from a first production zone in the subterranean formation during a first production period through the first flow path after both (a) and (b) until a flow rate from the first production zone reaches a first value. Further, the method comprises: (d) shutting in the first production flow path; (e) flowing gas from the first production zone during a second production period through the second flow path after (a), (b), and (d) until the flow rate from the first production zone reaches a second value that is smaller than the first value. Still further, the method comprises (f) shutting in the second production flow path.

These and other needs in the art are addressed in another embodiment by a method for producing gas from a well including a wellbore extending from a surface into a subterranean formation. In an embodiment, the method comprises: (a) installing a first production tubing string within the wellbore and (b) installing a second production tubing string within the wellbore. In addition, the method comprises (c) flowing gas from a first production zone in the subterranean formation through the first production tubing string after both (a) and (b). Further, the method comprises: (d) flowing gas from a first production zone in the subterranean formation through the second production tubing string during (c). Still further, the method comprises (e) determining a first pressure within the wellbore at an entrance of the first production tubing string and (f) determining a second pressure of gas within the first production tubing string at the surface. Also, the method comprises (g) regulating a flow of gas through the second production tubing string during (d) to minimize a difference between the first pressure and the second pressure.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
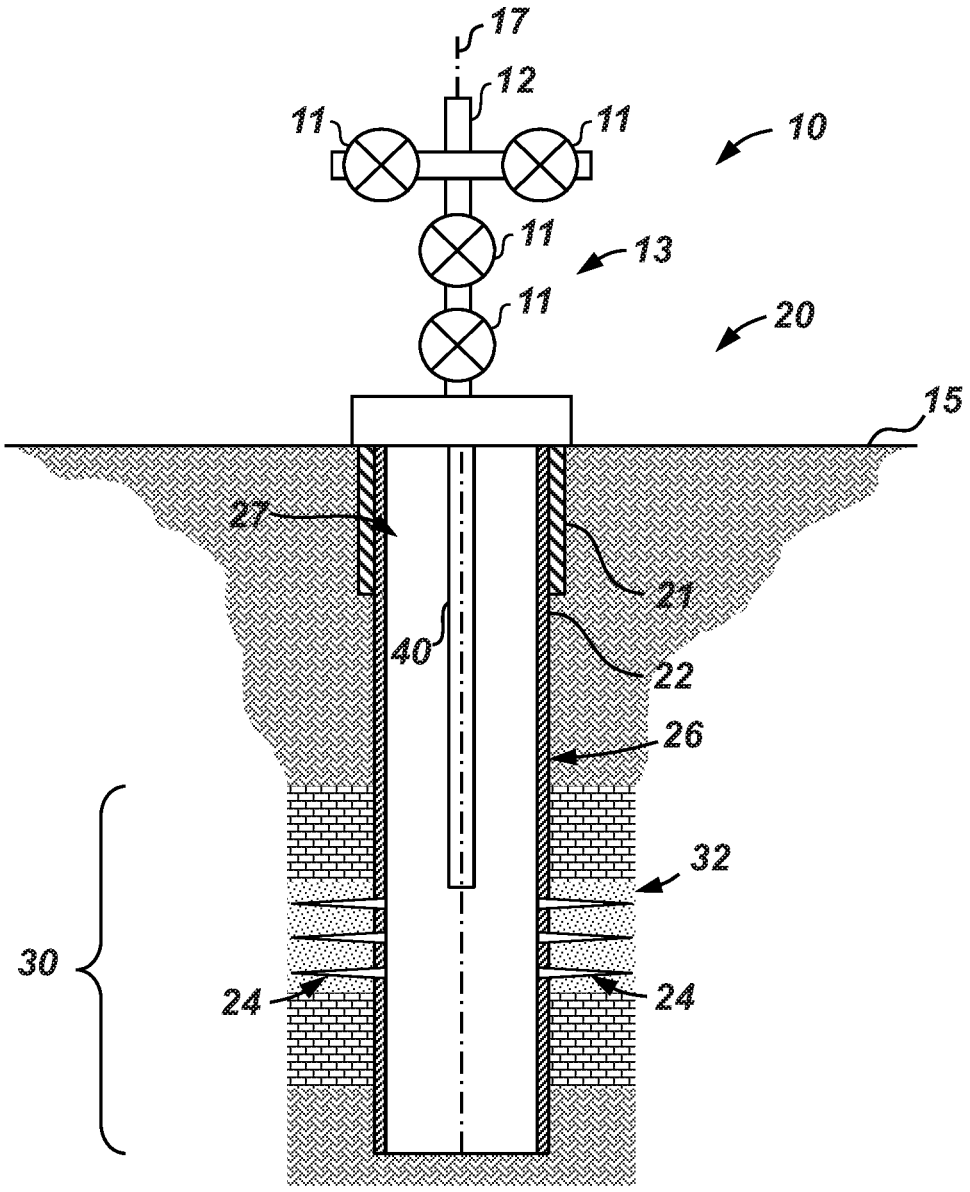
FIG. 1 is a schematic, partial cross-sectional view of a conventional system for producing hydrocarbon gases from a subterranean wellbore.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As used herein, the term "critical velocity" refers to the minimum velocity of a gas or other fluid required to carry a droplet of liquid (e.g., water) to the surface (e.g., surface 15) from a subterranean well. In general, the critical velocity can be calculated and/or determined by techniques known in the art that consider a multitude of factors including, without limitation, the liquid and gas phase densities of produced fluids, the surface tension of produced fluids, the pressure of the produced fluid as it traverses from the formation (e.g., formation 30) to surface, the viscosity of the produced fluid, and the temperature of the produced fluid. Without being limited by this or any particular theory, the actual velocity of produced gas to the surface is a function of the inner wellbore pressure at formation depth (specifically the difference between the pressure at formation depth and the surface pressure), the cross-sectional area/diameter of the flow path through which the produced gas flows, and the drag coefficient of the material making up the flow path. In particular, for gases flowing to the surface, the actual velocity of the produced gas is directly related to the inner wellbore pressure at the formation depth in the production zone of interest (i.e., the greater the inner wellbore pressure relative to the surface pressure, the greater the velocity of the produced gas to the surface, and vice versa); and also inversely related to the cross-sectional area/diameter of the flow path through which the produced gas flows (i.e., the smaller the cross-sectional area/diameter of the flow path, the greater the velocity of the produced gas, and vice versa). However, it should be appreciated that the flow of gas to the surface is also affected by relative pressures in the wellbore at the formation depth and within the formation itself. Specifically, the velocity of gas flowing into the wellbore is inversely related to the wellbore pressure at the formation depth, such that the velocity of gas flowing into the wellbore from the formation increases as the wellbore pressure at formation depth decreases relative to the formation pressure. In addition, for flow from the wellbore to the surface, if the cross-sectional area of the flow path is sufficiently small, then the friction between the inner surface of the flow path and the fluid flowing therethrough results in an overall decrease in the velocity of the fluid.

A related value to the critical velocity is the "critical rate" which, as used herein, refers to the minimum volumetric or mass flow rate of a gas or other fluid required to carry a droplet of liquid (e.g., water) to the surface (e.g., surface 15) from a subterranean well through a specific flow path having a known cross-sectional area. These two values are related in that the critical rate corresponds to flow at the critical velocity within a specific flow path.

Referring again to FIG. 1, as previously described, as well 20 matures, the formation pressure and volumetric flow rate of gas entering wellbore 26 from production zone 32 decreases. Once the velocity of the gas flowing from to the surface dips below the critical velocity, liquids begin to accumulate at the bottom of the wellbore 26 and exert a back pressure on production zone 32. To maintain and continue production from well 20, operators typically either deliquify the well 20 by pumping accumulated liquids to the surface 15 through tubing string 40 or engage in reworking or recompletion activities. Such processes require additional equipment and personnel, which increase the overall cost to produce well 20. However, as will be described in more detail below, embodiments disclosed herein provide for the installation of multiple tubing strings of varying diameters during the initial completion of the well (e.g., well 20) to provide a plurality of production flow paths for gas produced from a single production zone (e.g., zone 32) of a subterranean formation (e.g., formation 30), thereby enabling the production of gas above the critical velocity for longer periods of time without having to perform subsequent costly reworking operations.

Figure 2:
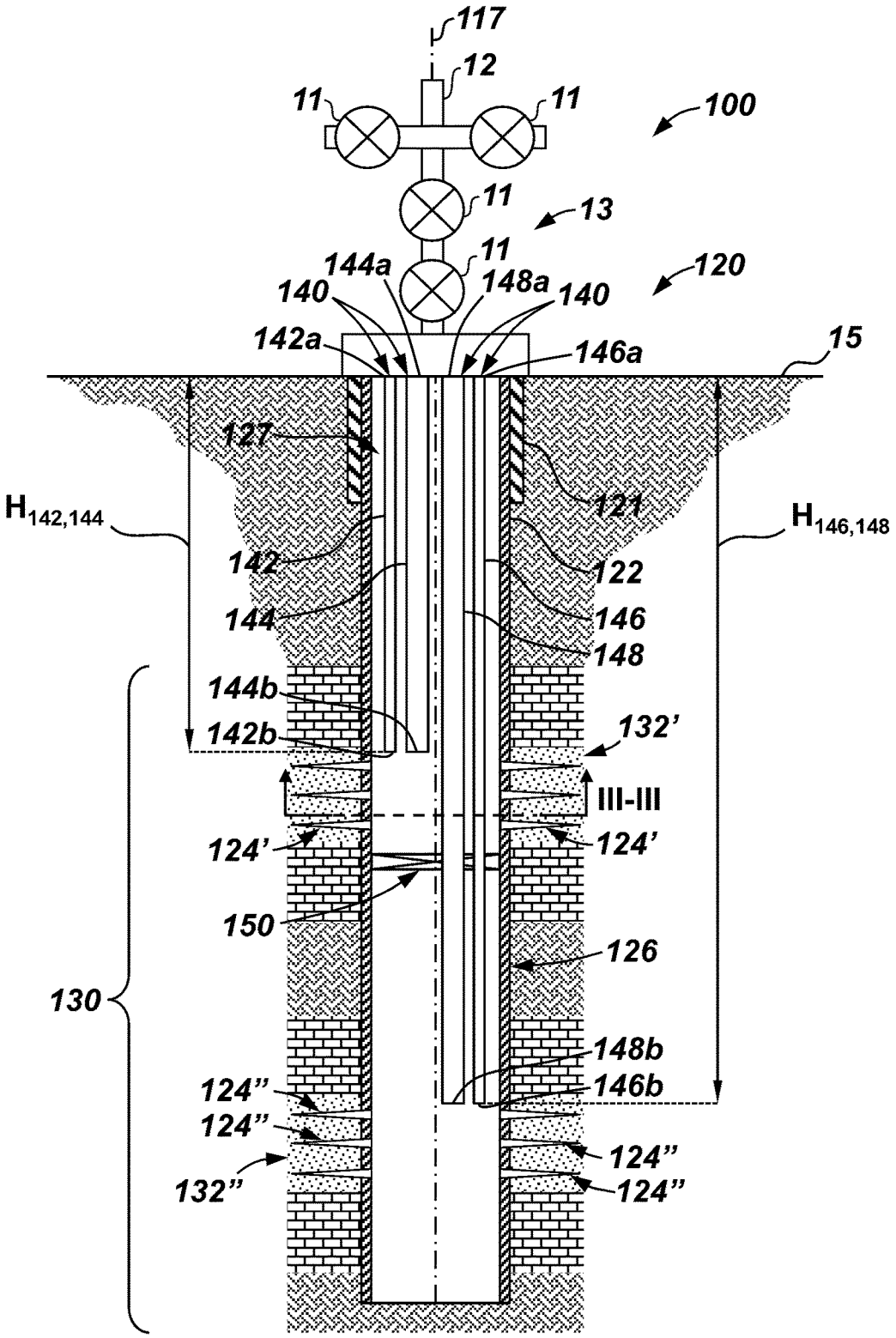
FIG. 2 is a schematic, partial cross-sectional view of an embodiment of a system for producing hydrocarbon gases from a subterranean wellbore in accordance with the principles disclosed herein.
Figure 3:
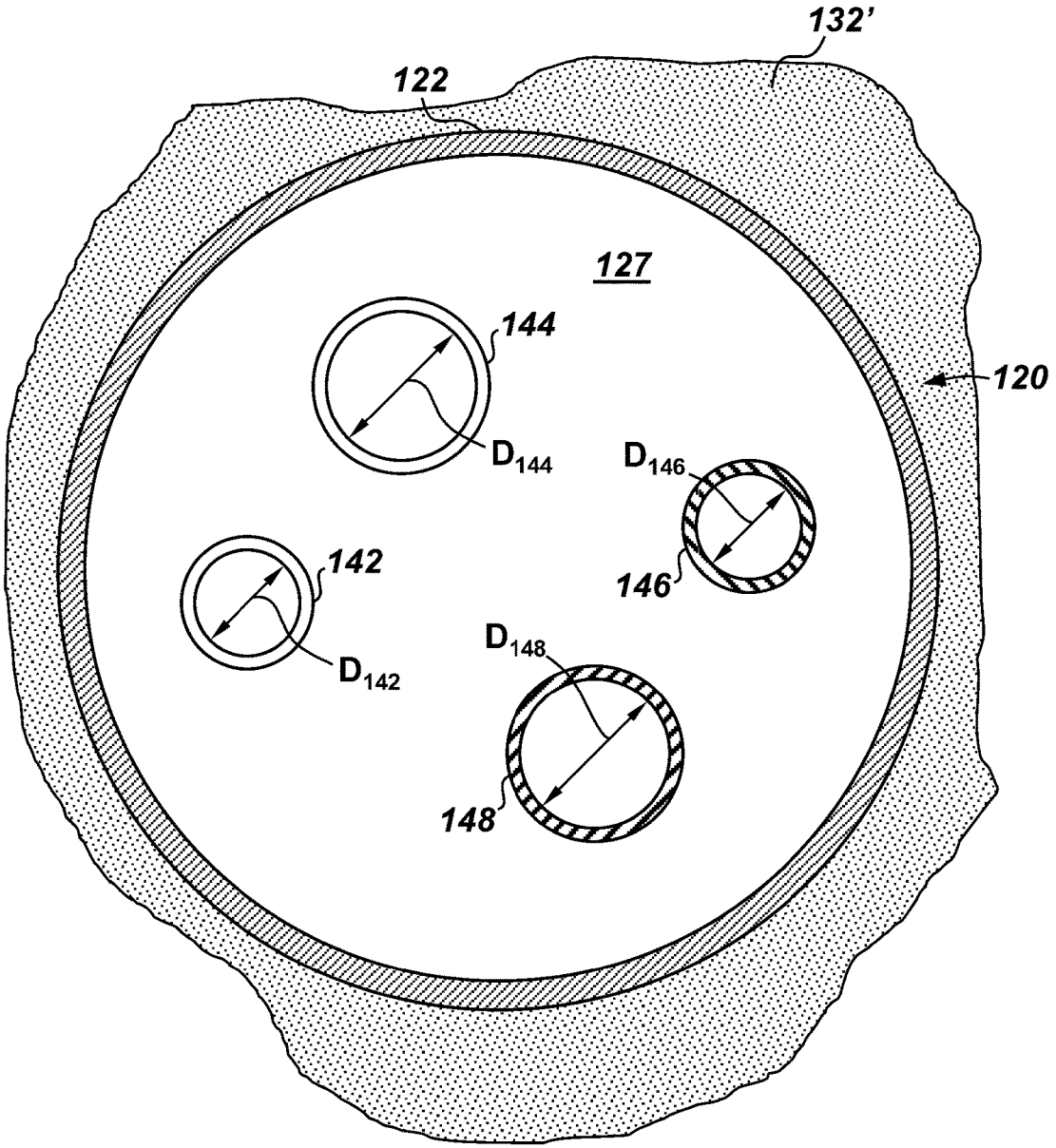
FIG. 3 is a schematic cross-sectional view of the system of FIG. 2 taken along section in FIG. 2.

Referring now to FIGS. 2 and 3, an embodiment of a production system 100 for producing hydrocarbon gas from a well 120 is shown. Well 120 includes a wellbore 126 that extends into a subterranean formation 130 along a longitudinal axis 117. In this embodiment, formation 130 includes a first or upper production zone 132' and a second or lower production zone 132" vertically spaced from first zone 132'. System 100 includes wellhead 13 disposed at the upper end of wellbore 126, a production tree 12 mounted to wellhead 13 at the surface 15, a primary conductor 121 extending from wellhead 13 into wellbore 126, and a casing 122 extending from wellhead 13 through conductor 21 and wellbore 126. A first or upper set of perforations 124' extend radially through casing 122 into first production zone 132' of formation 30, thereby providing a path for fluids in zone 132' to flow through casing 122 into wellbore 126. A second or lower set of perforations 124" are vertically positioned below perforations 124' and extend radially through casing 122 into production zone 132", thereby providing a path for fluids in zone 132" to flow through casing 122 into wellbore 126. A packer 150 is disposed within casing 122 axially between the zones 132', 132" (and corresponding perforations 124', 124", respectively), and restricts and/or prevents fluid flow between zones 132', 132" through casing 122 during production operations.

Referring still to FIGS. 2 and 3, system 100 also includes a plurality of elongate production tubing strings 140 generally extending from tree 12 into wellbore 126 through casing 122, thereby forming an annulus or annular flow path 127 radially positioned between strings 140 and casing 122. In this embodiment, four production tubing strings 140 are provided—a first production tubing string 142, a second production tubing string 144, a third production tubing string 146, and a fourth production tubing string 148. Each string 142, 144, 146, 148 has a first or upper end 142*a*, 144*a*, 146*a*, 148*a*, respectively, and a second or lower end 142*b*, 144*b*, 146*b*, 148*b*, respectively, opposite upper end 142*a*, 144*a*, 146*a*, 148*a*, respectively. The lower ends 142*b*, 144*b* of strings 142, 144, respectively, extend downhole to a first depth $H_{142,\ 144}$ measured from the surface 15, and the lower ends 146*b*, 148*b* of strings 146, 148 extends to a second depth $H_{146,\ 148}$ measured from the surface 15. Depth $H_{142,\ 144}$ is generally aligned with first production zone 132' and perforations 124', and depth $H_{146,\ 148}$ is generally aligned with second production zone 132" and perforations 124". In particular, in this embodiment, depth $H_{142,\ 144}$ is sized to place lower ends 142*b*, 144*b* of strings 142, 144, respectively, just above perforations 124', while depth $H_{146,\ 148}$ is sized to place lower ends 146*b*, 148*b* just above perforations 124". Thus, in this embodiment, strings 142, 144 extend to approximately the same depth and corresponding ends 142*b*, 144*b* are positioned to produce gas from first production zone 132', and strings 146, 148 extend to approximately the same depth and corresponding ends 146*b*, 148*b* are positioned to produce gas from second production zone 132". While embodiments described herein include a pair of production tubing strings extending to depths shown as approximately the same, such as production tubing strings 142, 144 extending to depths $H_{142}$, $H_{144}$, respectively, it should be appreciated that in other embodiments, the depths $H_{142}$, $H_{144}$ of each of the strings 142, 144, respectively may not be the same and still comply with the principles disclosed herein. Valves 11 on tree 12 are configured to allow the independent and selective control of the flow of fluids through each string 142, 144, 146, 148. Specifically, valves 11 can be independently and selectively actuated to restrict the flow of fluids through any one or more of strings 142, 144, 146, and/or 148. It should be appreciated that in at least some embodiments, the number of potential flow paths for produced fluids increases greatly with every additional tubing string (e.g., string 142, 144, 146, 148) that is installed within casing 122. For example, for a given production zone (e.g., zone 132', 132") when two tubing strings are installed (such as is shown in FIGS. 2 and 3) there is a total of three potential flow paths comprising various combinations and selections of each of the two installed strings. However, when three tubing strings are installed for production from a particular zone, there is a total of seven potential flow paths for fluids emitted from that zone. In addition, if the annulus (e.g., annulus 127) is also available as a potential flow path (e.g., for formation 132') then the number of available flow paths increases dramatically. For example, in the example described above in which there are three tubing strings installed, the addition of the annulus increases the total number of independent flow paths to fifteen.

Referring now to FIG. 3, each production tubing string 142, 144, 146, 148 has an inner diameter $D_{142}$, $D_{144}$, $D_{146}$, $D_{148}$, respectively, that defines the cross-sectional area of the path for produced hydrocarbon gases flowing therethrough. In this embodiment, the diameter $D_{144}$ of string 144 is larger than the diameter $D_{142}$ of string 142, and the diameter $D_{148}$ of string 148 is larger than the diameter $D_{146}$ of string 146. In other words, in this embodiment, each string 142, 144 at depth $H_{142-144}$ for producing production zone 132' has a different inner diameter $D_{142}$, $D_{144}$, and each string 146, 148 at depth $H_{146-148}$ for producing production zone 132" has a different inner diameter $D_{146}$, $D_{148}$. In this embodiment, annulus 127 has a cross-sectional area greater than the combined cross-sectional area of the flow paths of strings 142, 144, 146, 148; however, in other embodiments, annulus 127 may not have a larger cross-sectional area greater than the combined cross-sectional area of the flow paths of strings 142, 144, 146, 148 while still complying with the principles disclosed herein. As will be explained in more detail below, the diameter $D_{142}$, $D_{144}$, $D_{146}$, $D_{148}$ of each string 142, 144, 146, 148, respectively, is selected to produce hydrocarbon gases above the critical velocity to effectively lift water droplets produced with the gas to the surface 15 to prolong the operating duration of well 20 before deliquification or reworking is necessary. Further, those in the art will recognize that tubing strings employed may be tapered, i.e., the inner diameter of string 142 at upper end 142*a* is larger than the inner diameter of the string at lower end 142*b*, so that the string has a weighted average inner diameter across its length. For such tapered tubing strings, the tapered tubing string may have a larger effective diameter (and larger cross-sectional area) relative to another tubing string that has a smaller weight averaged inner diameter and still comply with the principles disclosed herein.

Referring still to FIG. 2, during production operations, hydrocarbon gases and other formation fluids (e.g., oil, water, condensate, etc.) flow into casing 122 from production zones 132', 132" of formation 130 through perforations 124', 124", respectively. Due to the presence of packer 150, fluid from zone 132' communicates with strings 142, 144 (but not strings 146, 148), and fluid from zone 132" communicates with strings 146, 148 (but not strings 142, 144). During the early stages of production, the pressure of zones 132', 132" is sufficiently high to produce gases to tree 12 above the critical velocity such that any liquids from zones 132', 132" are produced to the surface 15 along with the gas. However, as will be described in more detail below, as well 120 matures, the pressure within zones 132', 132" generally decreases, resulting, at least partially, in a decrease in the velocity of the produced gases. In embodiments described herein, operators can periodically manipulate the valves 11 on tree 12 to provide alternative flow path(s) for produced gases to ensure production above the critical velocity for longer periods of time by producing the gas through successively smaller flow paths (i.e., flow paths having successively smaller cross-sectional areas).

Figure 4:
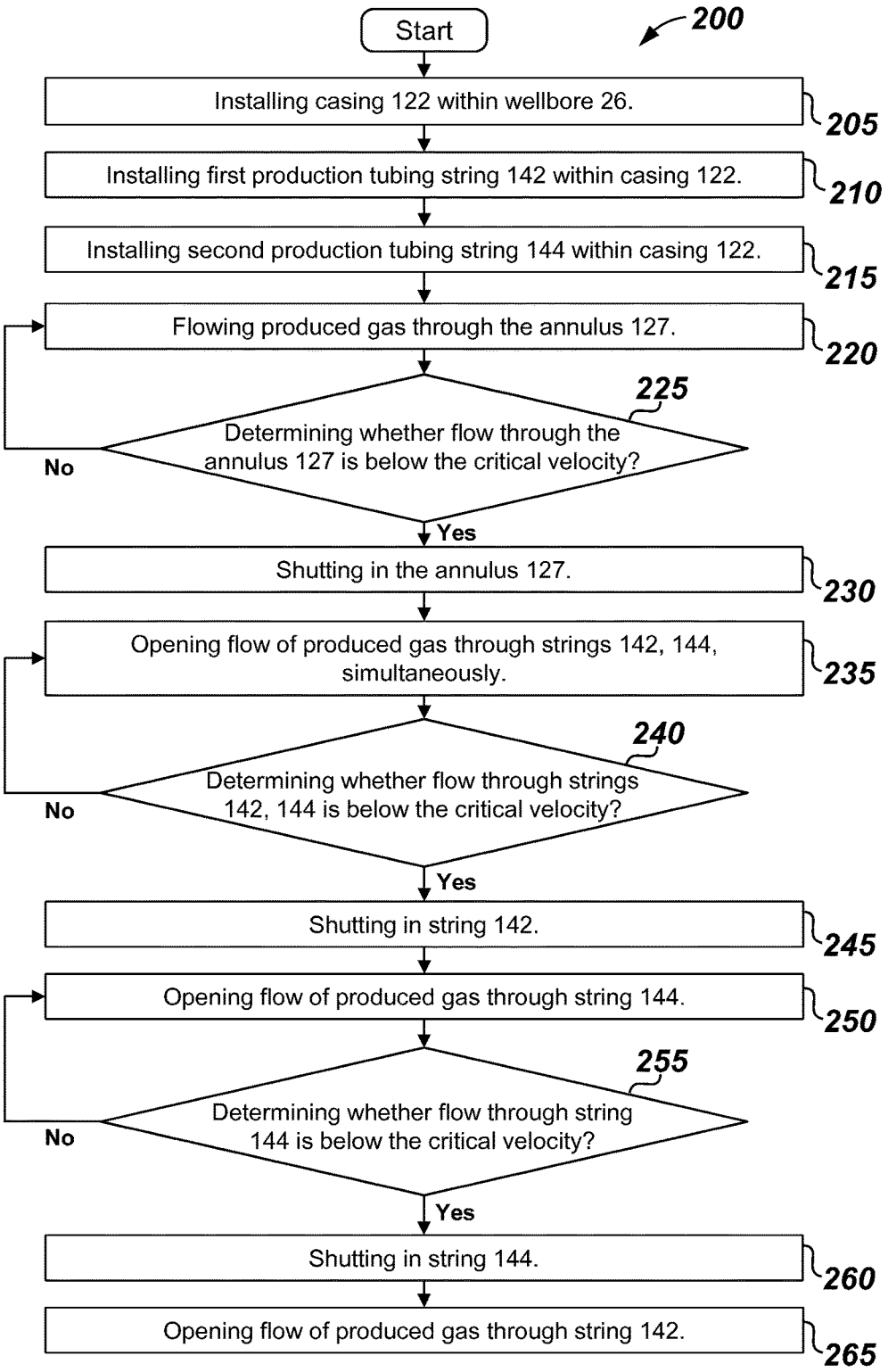
FIG. 4 is a flow chart illustration of an embodiment of a method in accordance with the principles disclosed herein for producing hydrocarbon gases with the system of FIG. 2.

Referring now to FIG. 4, an embodiment of a method 200 for producing hydrocarbon gas from production zone 132' of well 120 is shown. In describing method 200, reference will be made to system 100 shown in FIGS. 2 and 3 in an effort to provide clarity. In addition, in order to further enhance the explanation of method 200, reference will be made to FIG. 5 wherein a schematic production plan graph or chart 300 for production zone 132' of formation 130 is shown. In chart 300, the vertical or Y-axis 302 of chart 300 represents the production rate from production zone 132' of well 120 in thousands of cubic feet per day ("MCF/D"), while the horizontal or X-axis 304 represents time, which may be measured in hours, days, weeks, months, years, etc.

Referring specifically to FIG. 4, initially, method 200 begins by installing casing 122 within wellbore 126 in block 205, installing the first production tubing string 142 within casing 122 in block 210, and installing the second production tubing string 144 within the casing 122 in block 215. As is previously described and shown in FIG. 3, string 144 has a larger diameter (e.g., $D_{144}$) and cross-sectional area than the first production tubing string 142. Further, as described above, in this embodiment the annulus 127 formed between the production tubing strings 142, 144 and the casing 22 has a cross-sectional area greater than the combined cross-sectional area of the production tubing strings 142, 144. Still further, as previously described, the lower ends 142*b*, 144*b* of the production tubing strings 142, 144, respectively, are positioned to produce from the upper production zone 132'.

Figure 5:
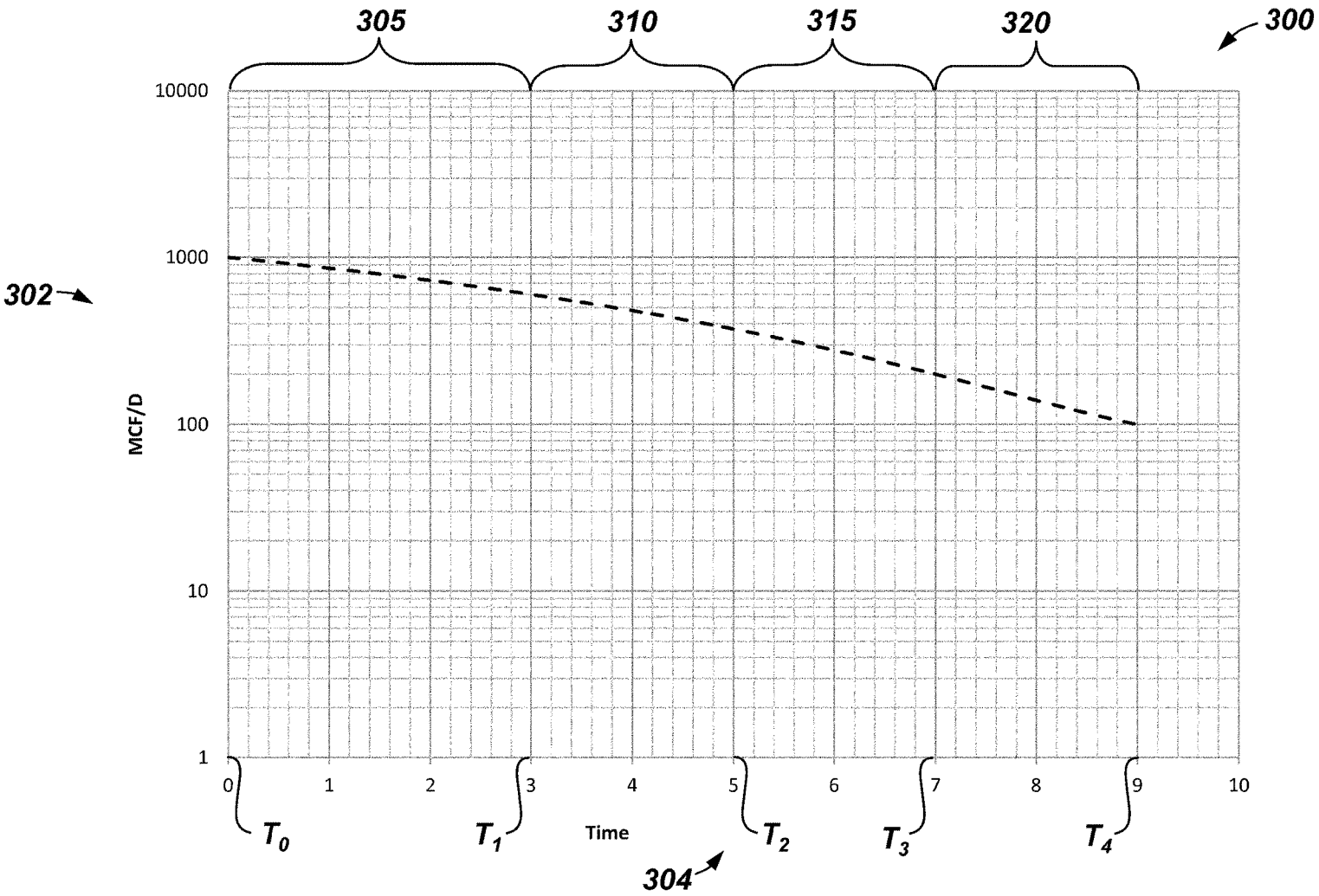
FIG. 5 is a graphical illustration of the gas production versus time for the system of FIG. 2.

The method 200 next includes producing gases from production zone 132' through annulus 127 at block 220. As shown in FIG. 5, throughout the production life of well 120, the pressure in the formation 130 drops relative to the pressure within wellbore 126 at the formation depth, thereby resulting in a continuous drop in the volumetric flow rate into the wellbore 126 from production zone 132'. Thus, production through annulus 127 at block 220 results in a first period or production 305 from zone 132' (i.e., from time $T_0$ to time $T_1$) wherein the pressure within and the flow rate from production zone 132' are relatively high, thereby allowing fluids produced from the production zone 132' to be routed or flowed up annulus 127 at a velocity greater than the critical velocity. Production in period 305 through annulus 127 continues until time $T_1$, when the pressure within and flow rate from production zone 132' have sufficiently decreased such that the produced gas flowing through annulus 127 has a velocity below the critical velocity. In order to raise the velocity of the produced gas back above the critical velocity, it becomes necessary to transition the gas production from annulus 127 to a smaller flow path.

Therefore, referring back now to FIG. 4, during production in block 220, a first determination 225 is made as to whether the velocity of gas produced through annulus 127 is less than the critical velocity. If "no" then produced gas continues to be flowed up annulus 127 in block 220. If "yes" then production is transitioned from the annulus 127 to the first and second production tubing strings 142, 144, respectively, by shutting in annulus 127 at block 230 and opening both the first and second production strings 142, 144, respectively to flow produced gases up the strings 142, 144 simultaneously at block 235. Although the transition of producing through the annulus 127 to producing through strings 142, 144 does not increase the total production rate, the smaller cross-sectional area of the strings 142, 144 (as compared to annulus 127) results in an increase in the actual total velocity of the produced gas above the critical velocity. In some embodiments, shutting in annulus 127 and opening flow through both strings 142, 144 is accomplished through manipulation of valves 11 on tree 12, previously described. As shown in FIG. 5, transitioning the flow from annulus 127 to strings 142, 144 in blocks 230, 235 marks the end of the first period of production 305 and the beginning of a second period of production 310 from production zone 132' (i.e., from time $T_1$ to time $T_2$). As previously described above for first production period 305, production in period 310 through strings 142, 144 continues until time $T_2$, when the pressure within and flow rate from production zone 132' have sufficiently decreased such that the produced gas flowing through strings 142, 144 has a velocity below the critical velocity. In some embodiments, this determination is made by analyzing the velocity and/or flow rate of the produced gas flowing through string 144 as flow through string 144 will, in at least some circumstances, tend to have a slower velocity due to its relatively larger diameter $D_{144}$ and thus cross-sectional areas as compared to string 142. In an effort to increase the velocity of the produced gas back above the critical velocity (to ensure adequate lifting of liquid droplets) it once again becomes necessary to transition from flow through strings 142, 144 simultaneously to a smaller flow path.

Thus, referring back now to FIG. 4, during production in block 235, a second determination 240 is made as to whether the velocity of gas produced through the first and second tubing production strings 142, 144 respectively, is less than the critical velocity. If "no" then produced gas continues to be flowed up strings 142, 144 in block 220. If "yes" then production is transitioned from strings 142, 144 to the second production tubing string 144 by shutting in the first production tubing string 142 at block 245 (e.g., through manipulation of valves 11 on tree 12) and opening flow of produced gas through the second production tubing string 144 in block 250. Again, while the transition of producing through string 142, 144 to producing through string 144 does not increase the total production rate, the smaller cross-sectional area of string 144 results in an increase in the actual total velocity of the produced gas above the critical velocity. Referring again to FIG. 5, transitioning from simultaneous flow through each of the strings 142, 144 to flow through only the string 144 marks the end of the second period of production 310 and the beginning of the third period of production 315 (i.e., from time $T_2$ to time $T_3$). As noted above for both the first and second periods of production 305, 310, respectively, production in period 315 through string 144 continues until time $T_3$, when the pressure within and flow rate from production zone 132' have sufficiently decreased such that the produced gas flowing through string 144 has a velocity below the critical velocity, thereby again resulting in the need to transition from flow through string 144 to a smaller flow path.

As a result, referring back now to FIG. 4, during production in block 250, a third determination 255 is made as to whether the velocity of gas produced through the second production tubing string 144 is less than the critical velocity. If "no" then produced gas continue to be flowed up the first production tubing string in block 250. If "yes" then production is transitioned from the second production tubing string 144 to the first production tubing string 142 by shutting in string 144 at block 260 and opening flow through string 142 in block 265. While the transition of producing through string 144 to producing through string 142 does not increase the total production rate, the smaller cross-sectional area of string 142 results in an increase in the actual total velocity of the produced gas above the critical velocity. As previously described, shutting in string 144 in block 260 and opening flow through string 142 in block 265 is accomplished, in some embodiments, through manipulation of valves 11 on tree 12. In some embodiments, production through string 142 continues until the pressure within and flow rate from zone 132' have sufficiently decreased such that the produced gases flowing through string 142 has a velocity below the critical velocity. Because string 142 represents the smallest flow path available within the embodiment of system 100 shown in FIGS. 2 and 3, production through string 142 continues until the level of accumulated liquids within wellbore 126 reaches a sufficient level to effectively choke off production from zone 132'. Thereafter, either production from zone 132' is ceased (thus resulting in an ever decreasing line tending to zero after $T_4$ in chart 300 shown in FIG. 5) or other remedial actions are taken, such as, for example, a deliquification process previously described.

While method 200 describes production from upper production zone 132' only, it should be appreciated that in this embodiment, gas in production zone 132" is produced in a similar manner; with the exception that annulus 127 is not available for production purposes due to packer 150. In particular, gas from production zone 132" is initially produced through strings 146, 148 simultaneously (annulus 127 is effectively shut-in by packer 150). When the velocity of produced gas in strings 146, 148 drops below the critical velocity (e.g., due to a decrease in the pressure within and flow rate from production zone 132"), valves 11 on tree 12 are actuated to transition gas production from strings 146, 148 to a smaller flow path to increase the velocity of the produced gas above the critical velocity. In particular, string 146 is shut-in, while string 148 remains open to produce gas through string 148. When the velocity of produced gas in string 148 drops below the critical velocity (e.g., due to a decrease in the pressure within and flow rate from zone 132"), valves 11 on tree 12 are actuated to transition gas production from string 148 to a smaller flow path to increase the velocity of the produced gas back above the critical velocity. In particular, string 148 is shut-in, while string 146 is open to produce gas through string 146.

Referring still to FIGS. 2-5, in general, the determination of the whether the actual velocity of the produced gas is above, at, or below the critical velocity (e.g., blocks 225, 240, 255) can be accomplished using any suitable means known in the art. In particular, in some embodiments, the determinations in blocks 225, 240, 255 are made by directly monitoring the velocity of the gas flowing through the relevant flow path. In other embodiments, the determinations in blocks 225, 240, 255 are made through measurement of other parameters. For example, in some embodiments, the actual production rate (e.g., the vertical axis of chart 300) for well 120 at a given time (e.g., $T_1$) can be measured and monitored to estimate whether the actual velocity of the produced gas is above, at, or below the critical velocity. Generally speaking, the measured production rate corresponds with the pressure of the formation 130, and thus, is directly related to the velocity of fluids produced therefrom. In other embodiments, still other known parameters may be used to make the determination of whether the velocity of the produced gas is above or below the critical velocity such as, for example, the pressure within formation 130 (or zones 132', 132"), the pressure within wellbore 126 (e.g., the static pressure within the wellbore 126 at or near the surface, the pressure at the production zones 132', 132"), the volumetric or mass flow rate of produced gases (from either zone 132' or zone 132"), the liquid content of fluids produced from well 120 (e.g., determining whether slugging is occurring or whether liquids are being produced as a relative constant mist), the difference between the casing pressure and the flowing tubing pressure (e.g., when casing annulus 127 is shut in), or some combination thereof.

As another example, in some embodiments, the pressure drop per unit length of a given flow path (e.g., annulus 127, string 142, and/or string 144) is measured to determine whether liquids (e.g., water) are accumulating within wellbore 126, and thus to influence the decision to transition to a smaller flow path. For instance, in some embodiments, both the surface pressure of the fluid produced from the well 120, and the static pressure within the wellbore 126 near the entrance of the currently utilized flow path are each measured and/or estimated. A pressure differential is then taken between these two values and then divided by the length of the current flow path, thereby resulting in the average pressure drop per unit length at specific point in time. When this value rises or increases, the increase serves, at least in some embodiments, as an indication that liquids are accumulating near the entrance of the current flow path. This therefore allows operators to conclude that it is now time to transition to a smaller flow path in order to raise the velocity of the gas back above the critical velocity, thereby reestablishing the lifting of liquid droplets to the surface.

In addition, in some embodiments the pressure of formation 130 and/or volumetric flow rate of produced gas over the entire expected producing life of well 120 is estimated prior to producing therefrom. Thus, in these embodiments, the relative sizing of strings 142, 144, 146, 148 (e.g., $D_{142}$, $D_{144}$, $D_{146}$, $D_{148}$) is chosen to produce flow above the critical velocity for most if not all of the producing life of well 120 based, at least partially, on the predetermined values of the formation pressure and the volumetric flow rate over that lifetime. For example, in some embodiments, the relative sizing of strings 142, 144, 146, 148 is determined by examining information received during completion activities of well 120. In particular, in these embodiments, an examination of the production rate of fluid occurring during completion activities is examined and may even be compared to the production rates of neighboring wells to estimate the likely decay of pressure within formation 130 during the producing life of well 120.

Further, while the determinations in blocks 225, 240, 255 have been described in terms of the critical velocity, it should be appreciated that in other embodiments, the determinations in blocks 225, 240, 255 may be carried out with consideration of the critical rate, while still complying with the principles disclosed herein. For example, in some embodiments, the determinations in blocks 225, 240, 255 may inquire as to whether the flow rate (e.g., volumetric of mass) of fluid flowing through a given flow path is below the critical rate (rather than the critical velocity) for that flow path.

In the manner described, systems and methods described herein offer the potential to enhance the production lifetime of a gas well by producing hydrocarbon gases from a subterranean production zone utilizing successively smaller flow paths to maintain the gas velocity at or above the critical velocity. As a result, liquids either do not accumulate or accumulate more slowly within the wellbore, thereby increasing the profit potential of such a well and reducing the need to take more conventional remedial actions such as, for example, deliquification or artificial lift processes.

While embodiments disclosed herein have described the initial stages of production as including fluid flow through the annulus 127, it should be appreciated that in other embodiments, the initial period of production (e.g., period 305 as shown in FIG. 5) for fluids produced from zone 132' may include flowing produced fluids through one or more of the strings 142, 144, 146, 148. Also, while the embodiment of method 200 described herein includes production through first the annulus 127, next through the strings 142, 144, then through the string 144, and then finally through the string 142, it should be appreciated that in other embodiments, the arrangement and order of the successive flow paths may be greatly varied while still complying with the principle disclosed herein. In addition, while embodiments disclosed herein have included two production tubing strings for each production zone (e.g., strings 142, 144 for zone 132' and strings 146, 148 for zone 132") it should be appreciated that in other embodiments, more or less than two production tubing strings may be included for each zone 132', 132" while still complying with the principle disclosed herein. Further, while the lower ends **142*b*, 144*b*, 146*b*, 148*b* of strings 142, 144, 146, 148 are described as extending within casing 22 such that lower ends 142*b*, 144*b* extend to substantially the same depth (e.g., $H_{142,\ 144}$), and ends 146*b*, 148*b* extend to substantially the same depth ($H_{146,\ 148}$), it should be appreciated that in other embodiments, lower ends 142*b*, 144*b* do not extend to substantially the same depth and/or lower ends 146*b*, 148*b* do not extend to substantially the same depth, all while still complying with the principles disclosed herein. Still further, while embodiments disclosed herein have shown each of the strings 142, 144, 146, 148 to extend separately within casing 22, it should be appreciated that in other embodiments, strings 142, 144, 146 and/or 148 may extend concentrically with one another. For example, in some embodiments, string 142 extends concentrically within string 144 and string 146 extends concentrically within string 148. Also, while embodiments disclosed herein have included a wellhead 13 having a production tree 12 further including a plurality of valves 11 to control the flow of fluids into and out form the wellbore 26, it should be appreciated that in other embodiments, any other suitable valving mechanism (i.e., other than tree 12) may be employed with embodiments of system 100 that is configured to control the flow of fluids into and out of the wellbore 26 while still complying with the principles disclosed herein. Further, in at least some embodiments the velocity of a fluid flowing through strings 142, 144, 146, 148 may vary between the entrance and exit thereof. Thus, one skilled in the art will appreciated that the determinations in blocks 225, 240, 255 may include determining whether the velocity is below the critical velocity at any point along the respective flow path, as such a velocity profile will result in an accumulation of liquids within the wellbore 126, in at least some circumstances. In addition, while casing 122 has been shown to extend substantially the entire length of wellbore 126, it should be appreciated that in other embodiments, casing 122 may not substantially extend along the entire length of wellbore 126** while still complying with the principles disclosed herein.

In some embodiments, the transition to a smaller tubing string (e.g., transitioning between the string 144 to the string 142) may overly constrict the flow of fluids from formation 130. In other words, at a given moment in time, the cross-sectional diameter of a given flow path may be small enough to produce flow above the critical velocity for a given formation pressure and flow rate, but may be so small that the rate of production is constricted due to the operation of frictional forces between the inner wall of the flow path and the fluids flowing therethrough. As a result, produced fluids (e.g., gas) begin to accumulate within the wellbore 126 and exert a back pressure on the formation 130 which decreases the total amount of potential production from the well (e.g., well 120). Thus, in some embodiments, it is desirable to incorporate a variable choke assembly into a production system (e.g., system 100) such that produced fluids are flowed through a first flow path that is sized to produce gas above the critical velocity to lift of liquid droplets to the surface (e.g., surface 15) while also flowing through a second choked flow path to produce an additional amount of produced fluids that would otherwise not be recoverable due to the undersized nature of the cross-sectional area of the first flow path.

Figure 6:
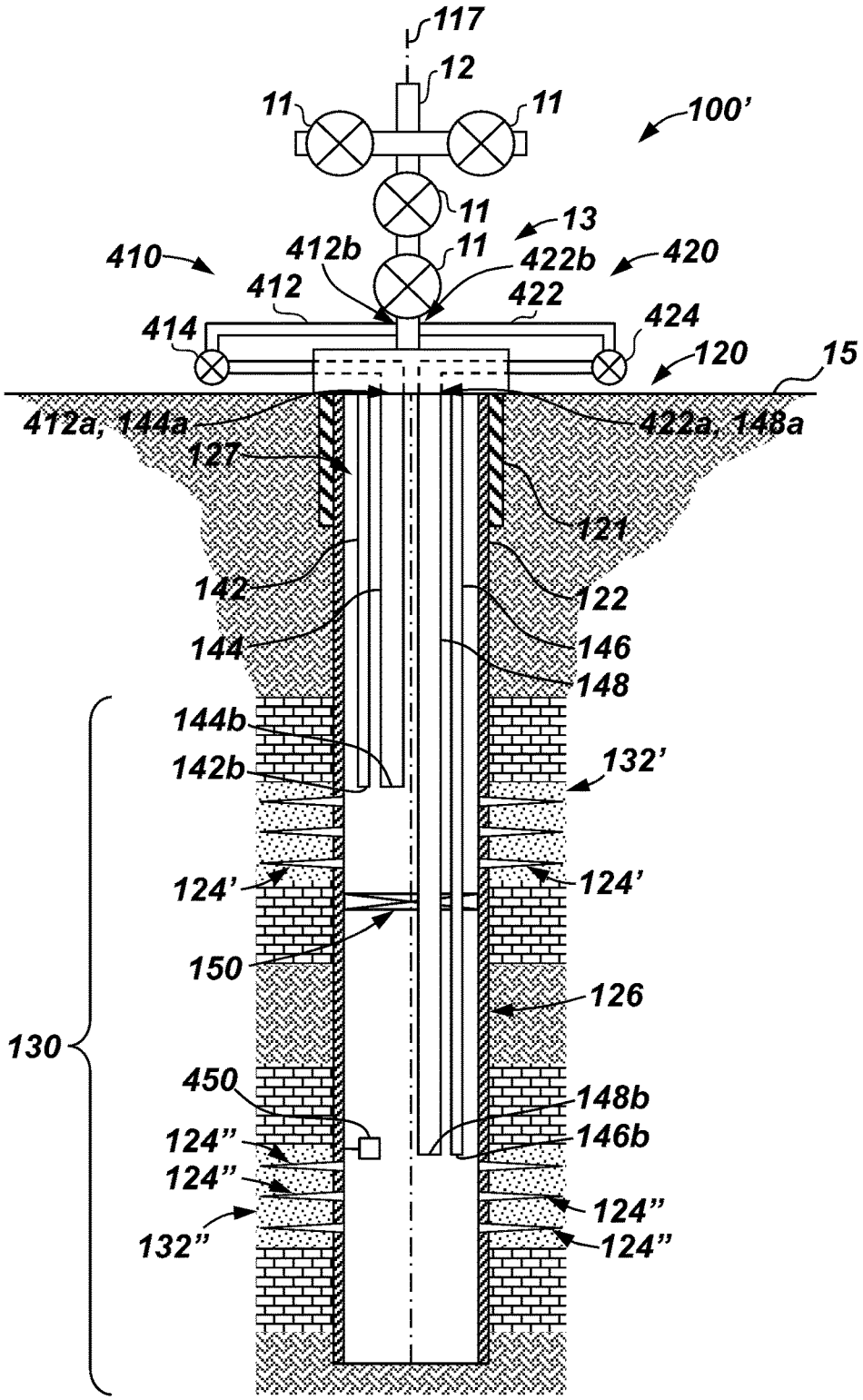
FIG. 6 is a schematic, partial cross-sectional view of an embodiment of a system for producing hydrocarbon gases from a subterranean wellbore in accordance with the principles disclosed herein.

For example, referring now to FIG. 6, an embodiment of a production system 100' for producing hydrocarbon gas from a well 120 is shown. System 100' is substantially the same as system 100, previously described, except that system 100' further includes a first variable choke assembly 410 and a second variable choke assembly 420. In this embodiment, the first choke assembly 410 includes a first flow conduit 412, and a first choke 414. Conduit 412 includes a first end 412*a* and a second end 412*b*. In this embodiment, first end 412*a* is coupled to upper end 144*a* of tubing string 144 while the second end 412*b* is coupled to tree 12. Therefore, conduit 412 defines a fluid flow path from upper end 144*a* of string 144 to tree 12. Choke 414 is disposed along conduit 412 between the ends 412*a*, 412*b*, and is configured to variably adjust the amount of fluids flowing to tree 12, through conduit 412, from tubing string 144 during operation. Similarly, in this embodiment, the second choke assembly 420 includes a second flow conduit 422 and a second choke 424. Conduit 422 is configured substantially the same as the conduit 412 previously described and includes a first end 422*a*, and a second end 422*b*. The first end 422*a* is coupled to the upper end 148*a* of string 148 while the second end 422*b* is coupled to tree 12. Therefore, conduit 422 defines a fluid flow path from upper end 148*a* of string 148 to tree 12. Second choke 424 is disposed along conduit 422 between the ends 422*a*, 422*b* and is configured to variably adjust the amount of fluids flowing to tree 12, through conduit 422, from tubing string 148 during operation. In this embodiment, conduits 412, 422 are each pipes however, it should be appreciated that any suitable fluid flow device may be used (e.g., hose, conduit, tubing, etc.). In addition, in this embodiment the first and second chokes 414, 424 are each valves; however, any other suitable device or mechanism for variably choking off the flow through a fluid flow channel (e.g., pipes 414, 424) may be used while still complying with the principles disclosed herein.

During production operations involving production zone 132', valves 11 on tree 12 are manipulated to fully open up string 142 to flow produced fluids therethrough. However, in some embodiments, while the cross-sectional area of tubing string 142 may be sufficiently small to flow produced fluids above the critical velocity for a given pressure and volumetric flow rate for zone 132', it may be sufficiently small that the frictional forces exerted on the produced fluid from the inner walls of tubing string 142 at least partially constrict the rate of fluid production therethrough. As a result, at least a portion of the produced fluids are not fully produced to the surface 15 thereby affecting the profitability of the well 120 in the manner described above. Thus, in at least some embodiments, when flow is transitioned to tubing string 142, the flow through string 144 is also opened and regulated by choke 414 within assembly 410 to ensure optimized flow from well 120 while also maintaining flow above the critical velocity within string 142. In at least some embodiments, the choke 414 is initially fully or nearly fully open since the pressure and volumetric flow rate from zone 132' is sufficiently high. However, as the pressure and the volumetric flow rate in zone 132' decreases, the choke 414 is actuated to progressively close off the flow through string 144 to ensure that the flow through the string 142 remains above the critical velocity. Eventually, choke 414 fully closes off flow through string 144, and produced fluids are directed up only the string 142 until the pressure and the volumetric flow rate in zone 132' decrease sufficiently such that flow through string 142 is no longer above the critical velocity and liquids accumulate within the wellbore 126. Thus, through use of the variable choke assembly 410, the production from zone 132' of well 120 is optimized over the life of well 120.

Similarly, during production operations involving production zone 132", valves 11 on tree are manipulated to open up string 146 to flow produced fluids therethrough. In addition and for the same reasons as discussed above, flow through tubing string 148 is also opened and regulated by choke 424 within assembly 420 in substantially the same manner as choke 410 to ensure optimized flow from zone 132" while also maintaining flow above the critical velocity through string 146 as the pressure and volumetric flow rate within zone 132" decrease throughout the life of well 120.

As previously described, in some embodiments, chokes 414, 424 are operated to adjust the rate of fluid production to ensure that the velocity of fluid flowing through the strings 142, 146, respectively, remains above the critical velocity and to ensure that production is not overly constricted through the strings 142, 146, respectively as the pressure and volumetric flow rate of fluids emitted from zones 132', 132" decrease over the life of well 120. Thus, in determining the amount to which to open or close flow through strings 144, 148 through chokes 414, 424, respectively, consideration is given to various factors, such as, for example, the liquid content of produced fluids, the pressure drop per unit length within each of the tubing strings 142, 144, 146, 148, the percentage of velocity above the critical velocity in the strings 142, 146, etc. In some embodiments, chokes 414, 424 are automated such that each choke 414, 424 is actuated by a controller (not shown) that determines (e.g., through consideration of the various factors listed above) the optimum percentage of flow necessary through the strings 144, 148, respectively, to enhance production from well 120 while still maintaining the lifting of liquid droplets to the surface 15.

In one particular embodiment, for production from zone 132', the determination as to the appropriate amount to open the choke 414 during production operations is made by comparing the pressure within the string 142 at the surface 15 to the pressure within the wellbore 126 near the entrance of the flowing string (e.g., at end 142*b*). Because overly constricted flow through string 142 will result in an accumulation of gas within the wellbore 126 and thus an increase in the pressure within the wellbore 126 relative to the pressure at the surface 15, the choke 414 is adjusted to minimize the pressure differential between these two pressure values and thus ensure that the flow from zone 132' is optimized. In at least some embodiments, the pressure within the flowing string 142 at the surface 15 is measured with transducers, gauges, or other suitable equipment disposed on tree 12. In addition, because the annulus 127 is shut-in, the pressure within the wellbore 126 at the entrance of string 142 is determined by measuring the static pressure within the annulus 127 at the surface 15 (or any other shut-in flow path that extends to the surface 15) and estimating the pressure at the entrance of string 142 by adding the additional pressure load exerted by the static column of fluid between the surface 15 and the lower end 142*b* of string 142.

Similarly, in some embodiments, for production from zone 132", the determination as to the appropriate amount to open the choke 424 during production operations is made by comparing the pressure within the string 146 at the surface 15 to the pressure within the wellbore 126 near the entrance of string 146 (e.g., at end 146*b*). For the same reasons articulated above, the choke 424 is actuated to minimize the differential between these two pressure values to thus ensure optimized flow from well 120. In addition, in some embodiments the pressure of the flowing string 146 at the surface 15 is measured in the same manner as described above for the string 142; however, due to the presence of packer 150, it is not possible to determine the pressure at the entrance of string 146 (e.g., at end 146*b*) by simply measuring the pressure within the annulus 127 and estimating the effects of the static column of fluid extending between the surface and the end 146*b*. Thus, in this embodiment, a pressure transducer 450 is placed within wellbore 126 proximate the depth of the entrance (e.g., $H_{146,\ 148}$ shown in FIG. 2) to directly measure the pressure at that point. However, it should be appreciated that in other embodiments, the pressure at the entrance point of the string 146 may be estimated by installing an additional, production tubing string (not shown) that extends below packer 150 and is shut in, measuring the pressure at the surface within the additional string, and the adding the additional pressure load exerted by the static column of fluid extending between the surface to the entrance of string 146 (e.g., end 146*b*). In addition, it should also be appreciated that, for production from the zone 132', the pressure at the entrance of the string 142 may be also be directly measured with a pressure transducer that is similar in form and function to the transducer 450, previously described.

In the manner described, through use of a production system (e.g., system 100') incorporating a variable choke assembly in accordance with the principles disclosed herein (e.g., assembly 410, 420, etc.), flow from a subterranean well (e.g., well 120) may be optimized to ensure that a sufficient flow of fluids is produced to the surface while also ensuring the removal of liquid droplets produced from the formation (e.g., formation 130) over at least a substantial portion of the life of the well.

While embodiments disclosed herein have shown the variable choke assemblies 410, 420 coupled to the strings 144, 148, it should be appreciated that the assemblies 410, 420 may be coupled to and thus may regulate the flow through any available flow path that is not currently being utilized within the well 120. For example, in some embodiments, the assemblies 410, 420 may be coupled to strings 142, 146 to regulate the flow therethrough while produced fluids are allowed to flow freely through the strings 144, 148, respectively. Additionally, as previously described, the number of tubing strings (e.g., strings 142, 144, 146, 148) installed within well 120 may be varied greatly while still complying with the principles disclosed herein. In addition, it should be appreciated that in some embodiments, the function performed by the variable choke assemblies 410, 420 may be incorporated into the method 200 previously described, such that transitioning to each successively smaller flow path throughout the life of well 120 (e.g., from strings 144 and 142 to only string 144 and transitioning from string 144 to string 142) also includes an additional step of regulating flow through an separate, currently unutilized (or shut in) flow path, to optimize the rate of production from well 120.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method for producing gas from a well including a wellbore extending from a surface into a subterranean formation, the method comprising:

(a) installing a first production tubing string within the wellbore;

(b) installing a second production tubing string within the wellbore;

(c) producing gas from a first production zone in the subterranean formation through the first production tubing string at a first velocity that is greater than a critical velocity after both (a) and (b);

(d) shutting in the first production tubing string and opening the second production tubing string after (c) after the first velocity decreases below the critical velocity to transition the production of gas from the first production zone from the first production tubing string to the second production tubing string, wherein the first production tubing string has a first inner diameter and the second production string has a second inner diameter that is less than the first inner diameter; and (e) producing gas from the first production zone through the second production tubing string after (d) at a second velocity that is greater than the critical velocity;

(f) producing gas from the first production zone through both the first production tubing string and the second production tubing string simultaneously before (c) and after both (a) and (b) at a third velocity that is greater than the critical velocity; and (g) shutting in the second production tubing string after (f) and before (c) when the third velocity decreases below the critical velocity to transition the production of gas from the first production zone from both the first production tubing string and the second production string to the first production tubing string;

(h) producing gas from the first production zone through an annulus disposed about the first production string and the second production string before (f) and after both (a) and (b) at a fourth velocity that is greater than the critical velocity; and (i) shutting in the annulus and opening the first production tubing string and the second production tubing string after (h) and before (f) when the fourth velocity decreases below the critical velocity to transition the production of gas from the first production zone from the annulus to both the first production tubing string and the second production string.

2. The method of claim 1, wherein the second velocity is greater than the first velocity when the production of gas from the first production zone is transitioned from the first production tubing string to the second production tubing string in (d).

3. The method of claim 1, further comprising:

(f) installing a third production tubing string within the wellbore;

(g) installing a fourth production tubing string within the wellbore;

(h) producing gas from a second production zone in the subterranean formation through the third production tubing string at a fifth velocity that is greater than the critical velocity after both (f) and (g), wherein the second production zone is below the first production zone;

(i) shutting in the third production tubing string and opening a fourth production tubing string after (h) after the fifth velocity decreases below the critical velocity to transition the production of gas from the second production zone from the third production tubing string to the fourth production tubing string, wherein the third production tubing string has a third inner diameter and the further production string has a fourth inner diameter that is less than the third inner diameter; and (j) producing gas from the second production zone through the second production tubing string after (i) at a sixth velocity that is greater than the critical velocity.

4. The method of claim 3, further comprising:

(k) producing gas from the second production zone through both the third production tubing string and the second production tubing string simultaneously before (h) and after both (f) and (g) at a seventh velocity that is greater than the critical velocity; and (l) shutting in the fourth production tubing string after (k) and before (h) when the seventh velocity decreases below the critical velocity to transition the production of gas from the second production zone from both the first production tubing string and the second production tubing string to the first production tubing string.

5. The method of claim 3, wherein sixth velocity is greater than the fifth velocity when the production of gas from the second production zone is transitioned from the third production tubing string to the fourth production tubing string in (i).

6. A system for producing hydrocarbons from a subterranean well including a wellbore extending from a surface into a subterranean formation, the system comprising:

a wellhead disposed at the surface;

a production tree coupled to the wellhead;

a casing coupled to the wellhead and extending into the wellbore; and a first plurality of production tubing strings extending into the casing from the wellhead to a first production zone, wherein each of the first plurality of production tubing strings is configured to provide a fluid flow path for gases from the first production zone;

wherein the production tree is configured to selectively and independently control fluid flow through each of the first plurality of production tubing strings;

a second plurality of production tubing strings extending within the casing to a second production zone, wherein the second production zone is farther from the surface than the first production zone; and where each of the second plurality of production tubing strings is configured to provide a fluid flow path for gases produced from the second production zone to the surface;

wherein the production tree is configured to selectively allow and restrict fluid flow through each of the second plurality of production tubing strings independently.

7. The system of claim 6, wherein the first plurality of production tubing strings comprise a first production tubing string and a second production tubing string;

wherein the production tree is configured to selectively allow and restrict fluid flow through the first production tubing string and/or the second production tubing string.

8. The system of claim 7, wherein the first production tubing string has an inner diameter D1, wherein the second production tubing string has an inner diameter D2, and wherein D1 is larger than D2.

9. The system of claim 7, wherein the first production tubing string extends to a first depth; wherein the second production tubing string extends to a second depth; and wherein the first depth and the second depth are substantially the same.

10. The system of claim 6, wherein the production tree includes a plurality of valves and the production tree is configured to selectively and independently control fluid flow through each of the first plurality of production tubing strings when at least some of the plurality of valves are actuated.

11. A method for producing gas from a well including a wellbore extending from a surface into a subterranean formation, the method comprising:

(a) installing a first flow path within the wellbore, wherein the first flow path has a first cross-sectional area;

(b) installing a second flow path within the wellbore, wherein the second flow path has a second cross-sectional area that is smaller than the first cross-sectional area;

(c) flowing gas from a first production zone in the subterranean formation during a first production period through the first flow path after both (a) and (b) until a flow rate from the first production zone reaches a first value;

(d) shutting in the first production flow path;

(e) flowing gas from the first production zone during a second production period through the second flow path after (a), (b), and (d) until the flow rate from the first production zone reaches a second value that is smaller than the first value;

(f) shutting in the second production flow path;

(g) installing a third flow path within the wellbore, wherein the third flow path has a third cross-sectional area;

(h) installing a fourth flow path within the wellbore, wherein the fourth flow path has a fourth cross-sectional area that is smaller than the third cross-sectional area;

(i) flowing gas from a second production zone in the subterranean formation during a third production period through the third flow path after both (g) and (h) until a flow rate from the second production zone reaches a third value, wherein the second production zone is farther from the surface than the first production zone;

(j) shutting in the third production flow path;

(k) flowing gas from the second production zone during a fourth production period through the fourth flow path after (g), (h), and (i) until the flow rate from the second production zone reaches a fourth value that is smaller than the third value;

(l) shutting in the fourth production flow path.

12. The method of claim 11, further comprising:

(m) determining that gas is flowing below a critical velocity through the first flow path during (c) and before (d) and (e).

13. The method of claim 12, wherein (m) comprises determining that a first pressure drop per unit length of the first flow path is increasing during (c) and after both (a) and (b).

14. The method of claim 11, further comprising:

(m) determining that gas is flowing below a critical velocity through the first flow path during (i) and before (j) and (k).

15. A method for producing gas from a well including a wellbore extending from a surface into a subterranean formation, the method comprising:

(a) installing a first production tubing string within the wellbore;

(b) installing a second production tubing string within the wellbore;

(c) flowing gas from a first production zone in the subterranean formation through the first production tubing string after both (a) and (b);

(d) flowing gas from a first production zone in the subterranean formation through the second production tubing string during (c);

(e) determining a first pressure within the wellbore at an entrance of the first production tubing string;

(f) determining a second pressure of gas within the first production tubing string at the surface;

(g) regulating a flow of gas through the second production tubing string during (d) to minimize a difference between the first pressure and the second pressure;

(h) shutting in an annulus disposed about the first production string and the second production string before (c) and (d); and wherein (e) comprises:

(e1) measuring a third pressure within the annulus at the surface;

(e2) estimating a fourth pressure exerted by a static column of fluid extending between the surface and the entrance of the first production tubing string; and (e3) adding the third pressure to the fourth pressure to determine the second pressure.

16. The method of 15, wherein (c) comprises flowing gas from the first production zone through the first production tubing string at a first velocity, wherein the first velocity is greater than the critical velocity.

17. The method of claim 15, wherein (e) comprises choking the flow through the second production tubing string using a variable choke assembly.

* * * * *